United States Patent [19]

Plate

[11] 3,949,783

[45] Apr. 13, 1976

[54] DUAL PUMP DRAFT CONTROL VALVE

[75] Inventor: John R. Plate, Milwaukee, Wis.

[73] Assignee: Allis-Chalmers Corporation, Milwaukee, Wis.

[22] Filed: Dec. 24, 1974

[21] Appl. No.: 536,244

[52] U.S. Cl. ..... 137/596.12; 60/486; 91/6; 91/47; 137/596.1 B; 137/625.3

[51] Int. Cl.[2] ..... F15B 13/09

[58] Field of Search ..... 91/6, 47; 60/421, 468, 60/486, 494; 137/596, 596.12, 625.68, 625.69, 596.18, 625.3

[56] References Cited

UNITED STATES PATENTS

| | | | |
|---|---|---|---|
| 1,855,060 | 4/1932 | Landenberger | 91/445 X |
| 3,185,175 | 5/1965 | Plate | 137/596.12 |
| 3,576,104 | 4/1971 | Kokaly et al. | 91/6 X |
| 3,596,560 | 8/1971 | Butterworth | 91/6 |

FOREIGN PATENTS OR APPLICATIONS

| | | | |
|---|---|---|---|
| 271,214 | 5/1970 | U.S.S.R. | 137/596 |

*Primary Examiner*—Alan Cohan
*Assistant Examiner*—Gerald A. Michalsky
*Attorney, Agent, or Firm*—Arthur L. Nelson

[57] ABSTRACT

A draft control valve for use with two constant displacement pumps in an open center hydraulic system. The valve controls the implement position in response to the draft loads and manual control and normally employs pressurized fluid from a low volume pump for operating in response to draft load sensing for control the implement position and employs pressurized fluid from the high volume pump for relatively short periods of time for positioning of the implement in response by the operator and extreme draft loads.

10 Claims, 8 Drawing Figures

Fig. 4
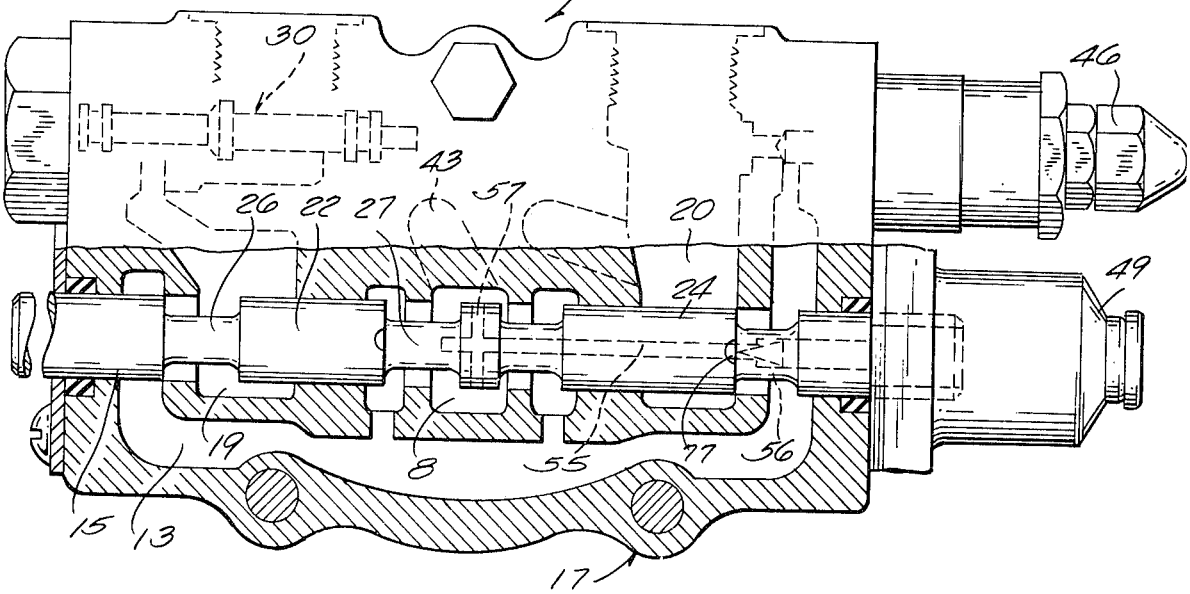
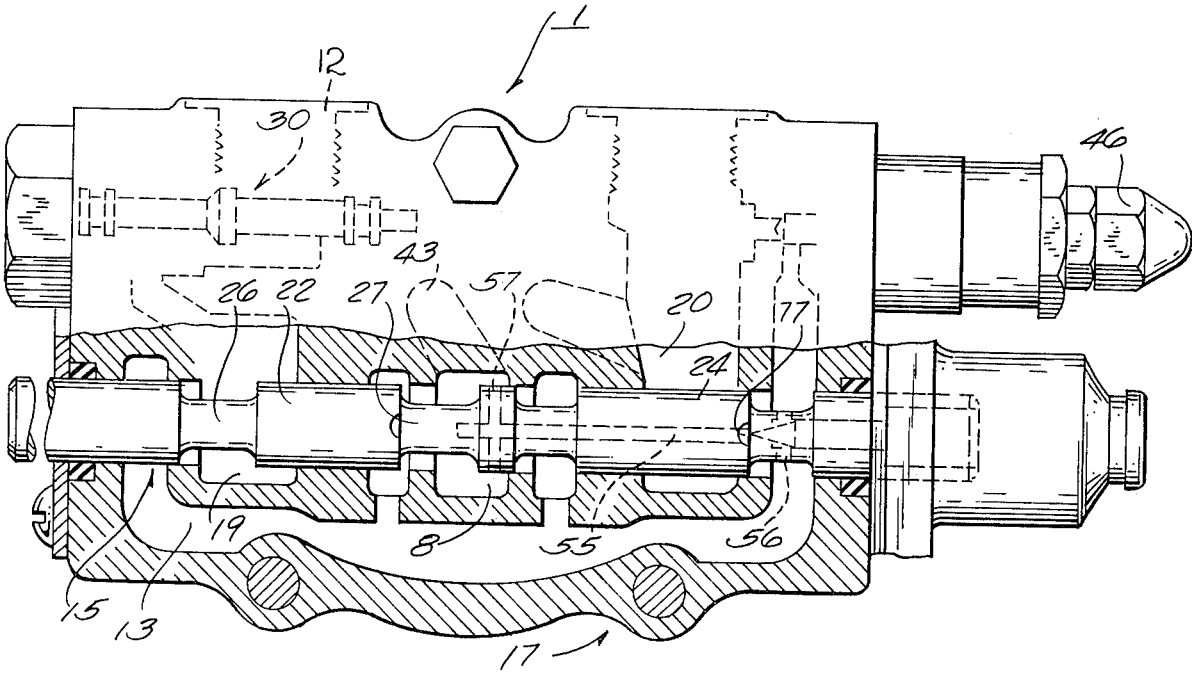
Fig. 5

Fig. 6
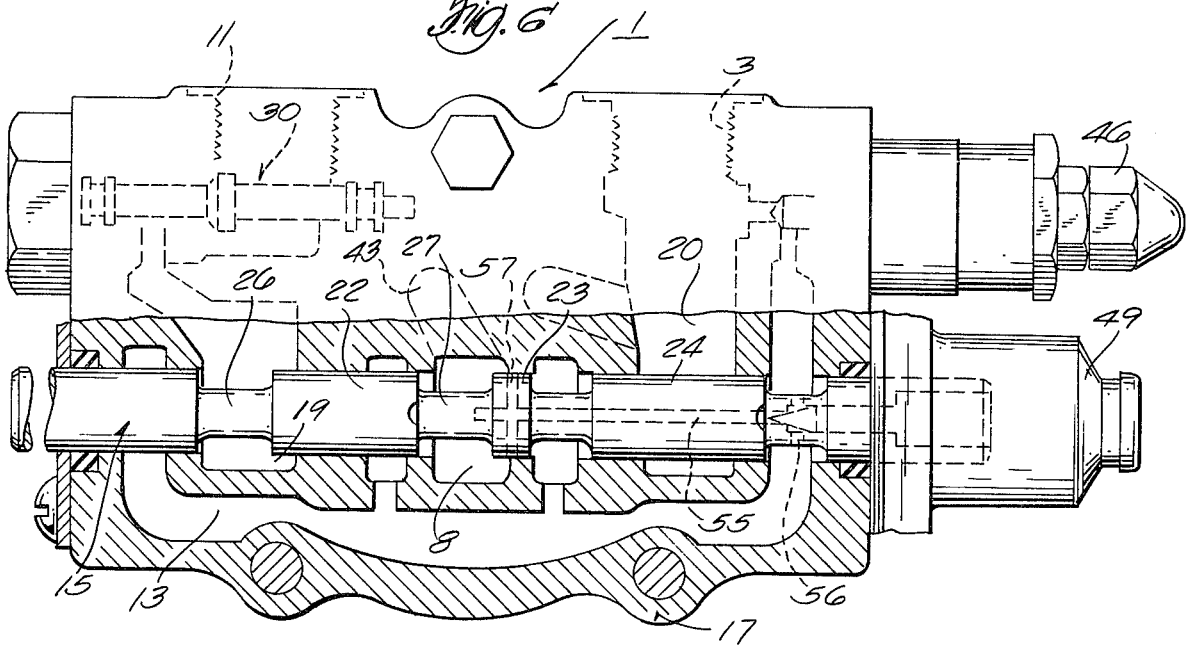
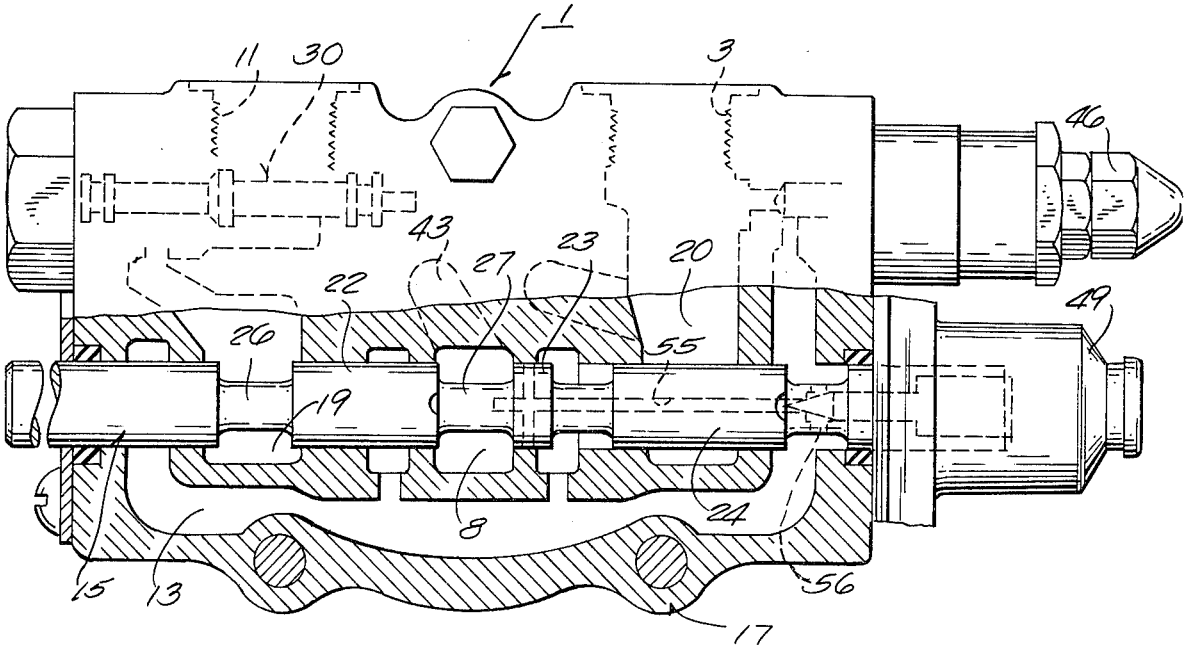
Fig. 7

DUAL PUMP DRAFT CONTROL VALVE

This invention relates to a hydraulic control valve and more particularly to a draft control valve for use with a low volume pump and a high volume pump both of constant displacement. The valve controls the implement position relative to the draft load and normally operates from the low volume pump and uses the high volume pump for relatively short periods of time when high volume is needed for positioning of the implement.

The modern tractor employs hydraulic auxiliary equipment operated in a hydraulic system in which a hydraulic pump is used to supply the pressurized fluid to operate the auxiliary equipment. The hydraulic system may employ one or a number of hydraulic pumps to supply the quantity of pressurized fluid at the desired pressure for the particular operation which is required by the tractor. A single hydraulic pump which is pressure compensated to vary the volume of the displacement of the pump in response to the load required can be used to operate this auxiliary equipment. This type of a pump, however, is more complex and, accordingly, more expensive than the constant displacement pump or pumps in the hydraulic system. Accordingly, for some purposes, it is more economical to employ one or a number of constant displacement pumps and have means for placing the pumps in communication through the valve to operate the particular hydraulic equipment necessary.

Accordingly, where a small volume is used, a low volume pump may be employed to provide the normal operation of the auxiliary equipment and the use of a high volume pump may be used in intermittent operation and connected to the auxiliary equipment whenever the high volume displacement is necessary. Accordingly, this invention is intended to provide such an arrangement whereby a low volume constant displacement pump is used for normal operation of the equipment and a high volume constant displacement pump is used in intermittent operations with a valve for selectively connecting the pumps to the auxiliary equipment for short periods of time. Although the hydraulic system operates various types of equipment, these pumps are intended to operate in connection with a draft load control valve. The draft load control valve positions the implement relative to the tractor in response to draft loads on the tractor and also suitable control levers are provided for manual operation of the control valve to raise and lower the implement as desired by the operator.

Accordingly, it is an object of this invention to provide a draft control valve operating with two hydraulic pumps in an open center hydraulic system.

It is a further object of this invention to provide a draft control valve operating in an open center hydraulic system with a high volume hydraulic pump operating against relatively low pressures in standby operation most of the time to provide fast implement control and a low volume hydraulic pump operating to supply hydraulic fluid to the system for slower lift and lower control of the implement.

It is a further object of this invention to provide a draft control valve having a single spool operating to control high volume and low volume constant displacement pumps in an open center system to control the position of the implement drawn by a tractor.

The objects of this invention are accomplished by a single spool hydraulic valve for connection with a low volume constant displacement pump and a high volume constant displacement pump in an open center hydraulic system. The pumps are selectively connected by the control valve to hydraulic lift cylinders and to sump for selectively raising the implement or lowering the implement in accordance with draft load signals in response to draft loads on the tractor. A pressure controlled check valve is positioned in the passage leading to the hydraulic lift cylinder which is pressure controlled to hold the check valve in the normal operational mode. The spool in the control valve selectively controls the flow of fluid from the pumps to the hydraulic actuator or sump in response to position of the spool in the valve. The control valve normally shunts hydraulic fluid to sump when pressurized fluid is not required to raise the implement or hold the implement in its holding position. The control valve restricts the flow of pressurized fluid to sump and the fluid is forced into the hydraulic lift cylinder at a rate determined by the position of the control valve and orifice means in the control valve to lift or hold the implement. A restricted flow for return of hydraulic fluid from the hydraulic lift cylinder is also provided in the control valve to control the rate of lower of the implement in response to positioning of the spool in the control valve which opens and closes passages between the hydraulic lift cylinder and sump.

The preferred embodiment of this invention is illustrated in the attached drawings.

FIG. 4 is a cross section view similar to FIG. 1 with the control valve shown in the draft load controlled lower position as used with a draft load sensing mechanism;

FIG. 5 is a cross section view similar to FIG. 1 with the control valve shown in the low volume draft load controlled lift position for use with the draft load sensing mechanism;

FIG. 6 is a cross section view similar to FIG. 1 with the valve positioned in the minimum flow lift position for manual and/or draft load operation of the valve; and FIG. 7 is a schematic illustration of the control valve as shown in FIG. 1 with the control valve in the fast lift position and manual and/or draft load control of the valve.

Figure 1:
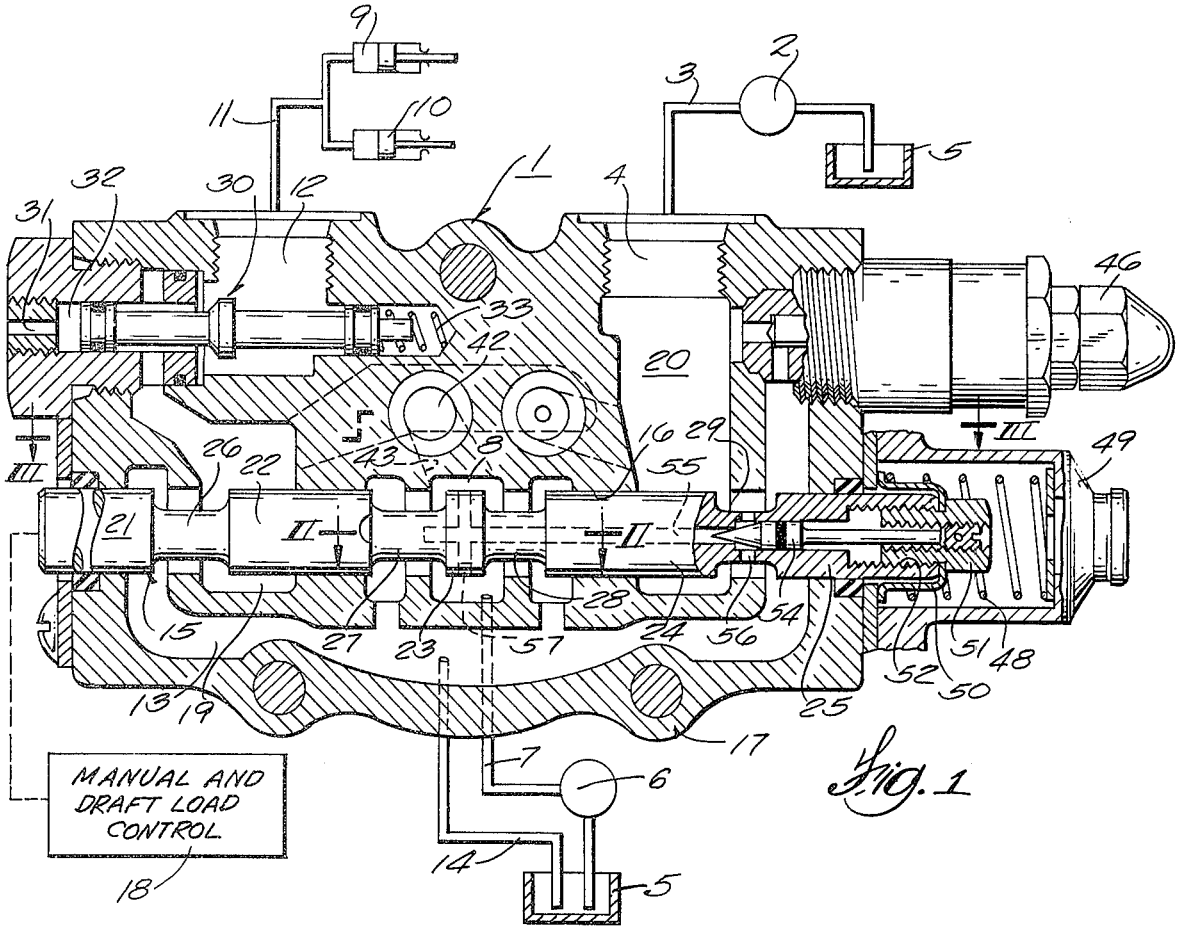
FIG. 1 illustrates a cross section view of the control valve showing the spool and the chambers in the valve connected to the high volume pump and the low volume pump and chamber connected to sump and to the hydraulic lift cylinder, the valve is shown in the fast lower position.
Figure 3:
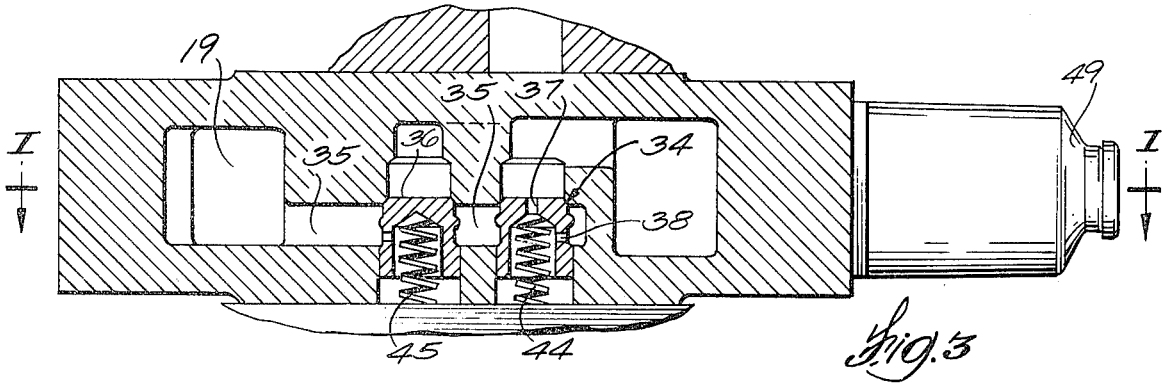
FIG. 3 is a cross section view taken on line III—III of FIG. 1.
Figure 2:
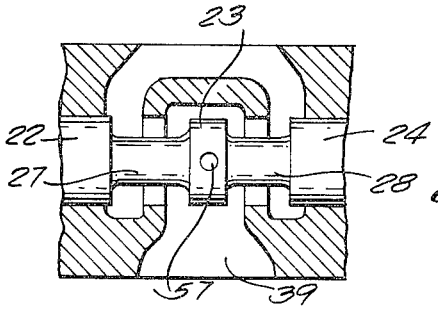
FIG. 2 is a cross section view taken on line II—II of FIG. 1.

FIG. 1 shows the control valve 1 in fast lower position and showing a low volume pump 2 connected to conduit 3 to a low volume pump passage 4. The low volume constant displacement pump 2 receives fluid from the reservoir 5.

Similarly, high volume constant displacement pump 6 receives hydraulic fluid from a sump 5 and pressurizes fluid in the conduit 7 which is connected to the high volume pump chamber 8. The hydraulic actuators 9 and 10 are connected through conduit 11 to the hydraulic actuator passage 12. A sump 5 is connected to the sump chamber 13 through conduit 14.

A spool 15 extends through the central opening 16 in the valve housing 17. The spool 15 is connected to a draft load control and a manual control 18 which operates the spool 15. The draft load control and manual control 18 adapted for operating a draft control valve of this type is illustrated in the U.S. Pat. No. 3,789,694 by Robert C. Haupt entitled "Friction Block for Lever." Although the patent is directed toward a specific lever for operation of this type of a draft control valve, the mechanism may be used with the valve of the type shown in FIG. 1.

The central opening 16 extends through the valve housing 17. The hydraulic actuator chamber 19, and the sump chamber 13 are in communication with the central opening 16. The low volume displacement chamber 20 and the high volume pump chamber 8 are in communication with the central opening 16. The spool 15, however, includes a plurality of lands 21, 22, 23, 24 and 25 which form grooves 26, 27, 28 and 29 intermediate the lands. The spool 15 is reciprocated in the central opening 16 as it selectively connects the high volume pump chamber 8 and the low volume pump chamber 20 with the hydraulic actuator passage 12 for lifting the implement. The hydraulic actuator chamber 19 is selectively connected to sump 13 for lowering of the implement when the pilot pressure controlled check valve 30 is open. The pilot pressure controlled check valve 30 is normally open since a passage 31 is normally connected to pressurized fluid. Pressurized fluid in the chamber 32 opens the check valve 30 against the force of spring 33 in a sump vented chamber.

Pressurized fluid from the low volume pump 2 is admitted through the passage 4 and chamber 20. Fluid is permitted to pass through the check valve 34 to the valve chamber 35 which is in communication with the hydraulic actuator chamber 19. Similarily, hydraulic fluid in the high volume pump chamber 8 is admitted through the check valve 36 into the valve chamber 35 and the hydraulic actuator chamber 19. Check valve 34 is provided with an axial orifice 37 and radial orifices 38 permitting the flow of fluid through the check valve 34 from the valve chamber 35 to the low volume pump chamber 20 when hydraulic fluid is discharged from the hydraulic actuators 9 and 10.

The high volume pump 6 is connected through the high volume pump passage 7 to the high volume pump chamber 8. High volume pump chamber 8 is in communication with passage 42 through the connecting passage 43. The check valves are biased to a closed position by means of the springs 44 and 45, respectively.

Figure 8:
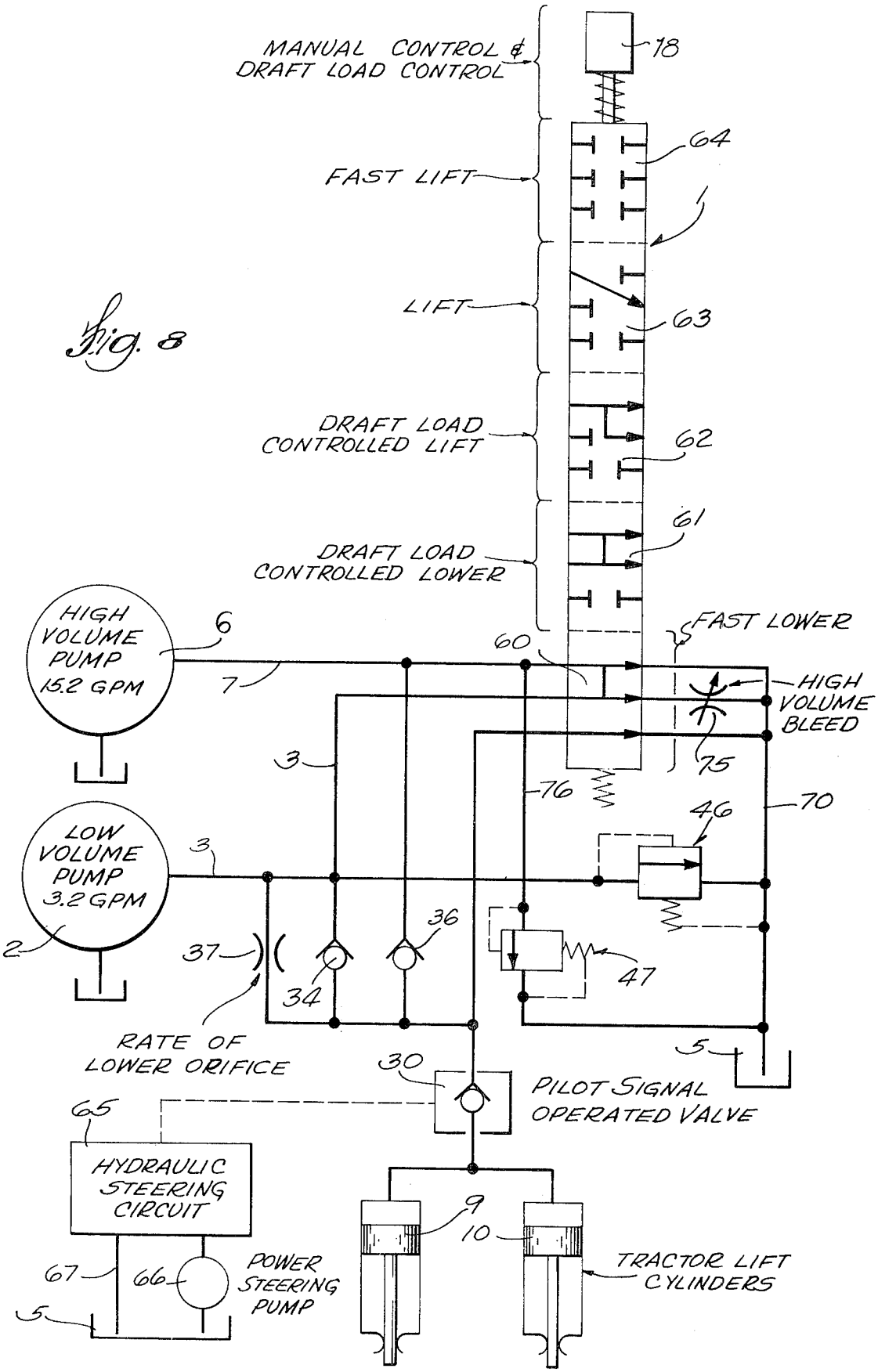
FIG. 8 is a schematic illustration of the hydraulic system.

The low volume pump chamber passage 20 is connected through the relief valve 46 to the sump chamber 13. Relief valve 47 is provided in the high volume pump circuit for discharging fluid above a predetermined pressure into the sump 5. This is shown in FIG. 8.

A spool 15 is normally biased to the left hand position by the spring 48 engaging the cap 49 and the spring retainer 50. The spring retainer 50 is held in position by the screw 51 threadedly engaging the inner periphery of an opening 52.

The adjustable orifice screw 54 threadedly received inside the screw 51 adjusts the opening of the axial passage 55 in the spool 15. The radial ports 56 are in communication with the axial passage 55. Radial openings 57 in the land 23 are in communication with the axial passage 55 of spool 15.

FIGS. 4, 5, 6 and 7 illustrate various positions of the draft control valve. These various positions are also illustrated in the schematic diagram of the circuit shown in FIG. 8. Referring to the control valve 1, shown in the schematic diagram of the hydraulic circuit in FIG. 8, the section 60 is shown in FIG. 1 in the fast lower position of the spool 15. Section 61 of valve 1, shown in FIG. 8, is illustrated by FIG. 4 in the draft load controlled lower position. Section 62, as shown in FIG. 8, is illustrated in FIG. 5 as the draft load controlled lift position. Section 63 of control valve 1 in FIG. 8 is the manual lift position as shown in FIG. 6. The section 64 of the control valve 1 shown in FIG. 8 is also illustrated in FIG. 7 of the control valve in the fast lift position of the draft control valve 1.

FIG. 8 shows a high volume pump 6 selectively supplying pressurized fluid to the valve 1 where it is transmitted to sump 5 or the flow through the valve is interrupted and the fluid passes through conduit 7 and check valves 36 and 30.

The low volume pump 2 supplies pressurized fluid to the control valve 1 and the control valve selectively transmits fluid to the sump 5 or interrupts the flow of pressurized fluid to the sump and the pressurized fluid is directed to flow through the check valves 34 and 30 to the hydraulic actuators 9 and 10. The check valve 30 is a pilot pressure biased check valve which is normally open when there is pressure in the hydraulic steering circuit 65. The hydraulic steering circuit receives pressurized fluid from the pump 66. The pump 66 receives fluid from the sump 5 and the fluid is discharged from the steering circuit through the conduit 67 to sump 5.

The operation of the draft control valve will be described in the following paragraphs.

The draft control valve is designed to operate in an open center hydraulic system. An open center hydraulic system allows the hydraulic fluid to flow through the system and be returned to the reservoir if the pressurized hydraulic fluid is not needed to operate auxiliary equipment. Accordingly, when section 60 of the hydraulic control valve 1 is positioned as shown in FIG. 8 and in FIG. 1, the hydraulic fluid from the low volume pump 2 and the high volume pump 6 are allowed to pass through the control valve to sump. Hydraulic fluid from the high volume pump 6 passes through conduit 7 through section 60 of draft control valve 1 through conduit 70 to sump 5. The low volume pump 2 pressurizes fluid in conduit 3 which, in turn, passes through section 60 of valve 1 to conduit 70 to reservoir 5. Since there is pressure in the pressurizing chamber 32 of the pilot pressure check valve 30, the valve 30 is open and pressurized fluid flows through check valve 30 and section 60 of the control valve 1 to conduit 70 to reservoir 5. In this position, the implement is lowering since the draft control valve is in the fast lower position as shown by section 60 of control valve 1.

This position is also illustrated in FIG. 1 in which the high volume pump chamber 8 is connected directly to the sump chamber 13. The low volume pump chamber 20 is also directly connected to the sump chamber 13 and the hydraulic actuators 9 and 10 are connected through the pilot pressure check valve 30 directly through a hydraulic actuator chamber 19 to the sump chamber 13. The control valve is in the fast lower position.

Sections 61 and 62 are the normal range of control by the draft control linkage wherein the draft load on the lower draft arms controls the valve. When the control valve 1, as shown in FIG. 8 is moved to the position with the section 61 indicated as draft load controlled lower operating, the control valve is positioned as shown in FIG. 4. This is the draft load controlled lower position for lowering of the implement at a controlled rate responsive to draft loads on the tractor. The high volume pump 6 supplies pressurizing fluid which passes directly through conduit 7 and section 61 of the control valve 1 and conduit 70 to sump 5. A portion of the fluid goes through the axial passage at the spool 15 to sump. The low volume pump 2 pressurizes fluid which passes through conduit 3 and directly through section 61 of control valve 1 through the conduit 70 to sump 5. The fluid in the hydraulic actuators 9 and 10 is prevented from flowing directly through the section 61 of the control valve 1 because the passage is blocked between the hydraulic actuators and the reservoir 5. Accordingly, the fluid must flow through the orifice 37 and conduit 3 through the section 61 of control valve 1 to the sump 5. The flow of fluid from the hydraulic actuators 9 and 10 is restricted by the orifice 37 in check valve 34 which controls the rate of lowering the implement. It is noted that the passages in the section 61 of the control valve 1 are connected to permit a portion of pressurized fluid from the high volume pump chamber 8 to pass through the high volume bleed orifice 75 to sump.

Referring to FIG. 4, the pressurized fluid in the high volume pump chamber 8 is premitted to pass directly to the sump chamber 13. Pressurized fluid from the low volume pump chamber 20 is permitted to pass through the grooves 77 on the land 24 of spool 15 to sump chamber 13.

The hydraulic fluid from the actuators 9 and 10 returns through the rate of lower orifice 37 as shown in FIG. 8 which is the orifice 37 of check valve 34 which the control the rate of lower as the fluid is transferred from the hydraulic actuators 9 and 10 to the sump 5.

Section 62 shows that although the pilot pressure operated check valve 30 may be opened in response to a pressure signal, the cross port in section 62 of the valve is closed so the hydraulic fluid in the hydraulic actuators 9 and 10 is not permitted to flow to sump. The cross port for the low volume pump is also closed. Accordingly pressurized fluid from the low volume pump flows into the hydraulic actuators 9 and 10 and the implement is raised. The output from the high volume pump is transmitted through the section 62 of the control valve. The main portion of fluid flows directly to sump and a portion flows through the bleed orifice 75 to sump. The valve is in the draft load controlled lift position.

FIG. 5 illustrates the position of the valve per se. The hydraulic actuator passage 12 and the chamber 19 are not in communication with sump 13. The flow from the low volume pump 2 is interrupted by the spool as indicated by the position of the spool in FIG. 5. The flow from the high volume pump 6, however, is still permitted to pass to the sump chamber 13 and the pressurized fluid from the high volume pump is normally ineffective in maintaining any control on the hydraulic actuators 9 and 10.

When section 63 of the control valve as shown in FIG. 8, is in position for operation, the hydraulic valve is in the lift position. The cross port for the discharge of fluid from the hydraulic actuators 9 and 10 is closed. The cross port in the section 63 of control valve 1 for the low volume pump is also closed. The cross port for the discharge of fluid from the high volume pump is also closed, however, the bleed orifice 75 in the spool 15 of the control valve 1 is open which permits a portion of the fluid to be discharged into the sump chamber.

Referring to FIG. 6, this position of the valve is illustrated. It is noted that the actuator chamber 19 is closed off from sump chamber 13. The flow from the low volume pump chamber 20 to sump 13 is also interrupted. It is noted that the main flow from the high volume pump chamber 8 to sump chamber 13 is also interrupted. However, flow is permitted through the passage 55 in the spool 15 to the sump chamber. The valve is in the lift position but fluid is permitted to bleed off to the sump chamber 13 to decrease the rate of lift of the implement when the valve is in the lift position. The rate of bleed off is manually adjustable to suit the operator.

When the valve section 64 of the control valve 1, as shown in FIG. 8, is in position for operation in the control valve, communication between the hydraulic actuators 9 and 10 and sump as well as communication between both the low volume pump and the high volume pump to sump is interrupted. The fluid flow of the fluid from the pumps is then directed to the hydraulic actuators 9 and 10. This position of the control valve is the fast lift position.

This position is shown in FIG 7 in which all passages between the hydraulic actuators 9 and 10 and the high volume pump chamber 8 as well as the low volume pump chamber 20 to the hydraulic actuators 9 and 10 is interrupted. The position of the valve using sections 63 and 64 are normally manually controlled and used when it is desired to raise the implement rapidly. In these positions, the flow from both the low volume pump and the high volume pump is needed to provide the rate of lift desired by the operator.

Check valve 30 is a pilot pressure operated check valve which is normally open when the vehicle is in operation. The check valve 30 holds the implement in the raised position when the pressure is released in chamber 30 as when the vehicle is shut down. This allows a freer running spool 15 because of a greater tolerance in the fit.

The embodiments of the invention in which an exclusive property or privilege is claimed are defined as follows:

1. A draft control valve for use on a vehicle comprising, a valve housing defining a central opening interconnecting a low volume pump chamber, a high volume pump chamber, a hydraulic actuator chamber, and a sump chamber, hydraulic actuator passage means for connecting said hydraulic actuator chamber to a hydraulic actuator, a valve member received in said central opening for selectively alternately directing fluid flow from said pump chambers to said hydraulic actuator chamber and connecting said hydraulic actuator chamber to said sump chamber, a flow restrictor for restricting fluid flow from said hydraulic actuator passage means to said sump chamber, said valve member and said valve housing defining passage means and a variable orifice means connected in parallel for controlling the flow of fluid between said high volume pump chamber and sump chamber responsive to movement of said valve member, draft load control and manual control means selectively positioning said valve member for operation of said valve.

2. A draft control valve for use on a vehicle as set forth in claim 1 wherein said variable orifice means for restricting fluid flow between said high volume pump chamber and sump includes means positioning said variable orifice means in said valve member.

3. A draft control valve for use on a vehicle as set forth in claim 1 including check valve means between said low volume pump chamber and said hydraulic actuator passage means and a check valve means connected between said high volume pump chamber and said hydraulic actuator passage means.

4. A draft control valve for use on a vehicle as set forth in claim 1 including a check valve positioned between said low volume pump chamber and said hydraulic actuator passage means for permitting normal fluid flow from said pump chamber to said hydraulic actuator passage means, orifice means in said check valve permitting restricted flow from said hydraulic actuator passage means to said low volume pump chamber.

5. A draft control valve for use on a vehicle as set forth in claim 1 wherein said valve member defines a valve spool.

6. A draft control valve for use on a vehicle as set forth in claim 1 wherein said valve member defines a spool, wherein said spool interrupts communication between said low volume pump and said high volume pump and said sump chamber wherein the fluid flow is directed to said hydraulic actuator chamber for a lift position of said control valve.

7. A draft control valve for use on a vehicle as set forth in claim 1 wherein said control valve member defines a spool for positioning to allow fluid flow from said low volume pump chamber and high volume pump chamber to sump and permitting flow from said hydraulic actuator passage means to said sump to thereby define a lower position of said valve.

8. A draft control valve for use on a vehicle as set forth in claim 1 wherein said valve member defines a valve spool, means defining a bleed orifice through said spool for transmitting pressurized fluid from said high volume pump chamber to said sump chamber in selected positions of spool valve.

9. A draft control valve for use on a vehicle as set forth in claim 1 wherein said valve member defines a valve spool, said spool defines throttling grooves for selectivley throttling fluid from said high volume pump chamber to said sump chamber and throttling fluid from said low volume pump chamber to said sump chamber.

10. A draft control valve for use on a vehicle as set forth in claim 1 including a pressure controlled check valve defining a pressure chamber adapted for connection to a source of pressurized fluid for maintaining said valve open in response to pressurized fluid in said pressure chamber means positioning said check valve between said hydraulic actuator passage means and hydraulic actuator chamber.

* * * * *